US005759501A

United States Patent [19]

Livingston et al.

[11] Patent Number: 5,759,501

[45] Date of Patent: Jun. 2, 1998

[54] FLEXIBLE WALLED CONTAINER FOR TABLETED OR PELLETED WARE WASHING DETERGENTS

[75] Inventors: James Livingston, Santa Cruz, Calif.; Donald Wright, Mississauga, Canada; Tiziano J. Bellon, Northville; Kenneth James Roach, Canton, both of Mich.

[73] Assignee: Diversey Lever, Inc., Plymouth, Mich.

[21] Appl. No.: 749,834

[22] Filed: Nov. 15, 1996

Related U.S. Application Data

[63] Continuation of Ser. No. 489,561, Jun. 12, 1995.

[51] Int. Cl.[6] ..... B01D 11/02

[52] U.S. Cl. ..... 422/275; 422/266; 220/359; 215/307; 222/107; 222/210; 222/212; 68/17 R

[58] Field of Search ..... 422/266, 275; 220/372, 359; 215/232, 307, 308; 222/92, 107, 189.06, 210, 212; 134/93; 68/17 R

[56] References Cited

U.S. PATENT DOCUMENTS

| | | | |
|---|---|---|---|
| 2,604,386 | 12/1950 | Arant | 422/257 |
| 3,416,897 | 12/1968 | Long et al. | 422/264 |
| 3,583,602 | 6/1971 | Fruber | 222/92 |
| 4,426,362 | 1/1984 | Copeland et al. | 422/263 |
| 4,569,781 | 2/1986 | Fernholz et al. | 134/36 |
| 4,571,327 | 2/1986 | Larson et al. | 422/263 |
| 5,007,559 | 4/1991 | Young | 422/266 |
| 5,078,301 | 1/1992 | Gladfelter et al. | 222/52 |
| 5,086,950 | 2/1992 | Crossdale et al. | 222/88 |
| 5,147,615 | 9/1992 | Bird et al. | 422/266 |
| 5,174,828 | 12/1992 | Roth | 134/16 |
| 5,229,084 | 7/1993 | Livingston et al. | 422/278 |
| 5,251,656 | 10/1993 | Sexton, Sr. | 422/266 |
| 5,307,955 | 5/1994 | Viegus | 222/107 |
| 5,552,079 | 9/1996 | Roach et al. | 510/446 |

FOREIGN PATENT DOCUMENTS

| | | |
|---|---|---|
| 0268948 | 6/1988 | European Pat. Off. . |
| 0314890 | 8/1988 | European Pat. Off. . |
| 0345070 | 12/1989 | European Pat. Off. . |
| 0421538 | 1/1990 | European Pat. Off. . |
| 2561229 | 9/1985 | France . |
| 4202592 | 8/1993 | Germany . |
| 9404028 | of 0000 | United Kingdom . |
| 1079494 | 8/1967 | United Kingdom . |
| 9109561 | 7/1991 | WIPO . |
| 92/08548 | 5/1992 | WIPO . |
| 92/09521 | 6/1992 | WIPO . |
| 94/13187 | 12/1993 | WIPO . |

OTHER PUBLICATIONS

2244 Research Disclosure (1990) Mar., No. 311, New York. U.S. XP 000104553 Chemical Drum Connection, pp. 278–280, Disclosed by John R. Weaver II.

*Primary Examiner*—Robert J. Warden
*Assistant Examiner*—Fariborz Moazzam
*Attorney, Agent, or Firm*—A. Kate Huffman

[57] ABSTRACT

A container for institutional detergents, preferably tablets, includes a rigid large screened base and a flexible plastic film sidewall heat bonded to the peripheral surface of the base. The container is filled, preferably from its top portion, with tableted detergent and closed with a single heat seal along the top surface of the wall of the container. The screen surface is then closed with a removable, peel-off seal or removable cap. The upper portion of the container will include a handle which makes it easy to transport the container and place it into a dispenser for use. In use, a water nozzle will spray upwards onto the surface of the screen base through the holes in the screen, dissolving detergent and allowing the solution to pass downwardly to a drain, which directs it to a ware washing apparatus.

10 Claims, 3 Drawing Sheets

FLEXIBLE WALLED CONTAINER FOR TABLETED OR PELLETED WARE WASHING DETERGENTS

This application is a continuation of application Ser. No. 08/489,561 filed on Jun. 12, 1995.

BACKGROUND OF THE INVENTION

Special chemical dispensers are generally employed for institutional washing apparatuses, particularly ware washing machines. Restaurants, cafeterias and the like employ relatively large ware washing machines which frequently employ an automatic detergent dispenser.

In packaging and dispensing these detergents, there are several goals. Of course, the first is the effective, safe distribution of the detergent. In association with the effective distribution of the detergent, the dispensing rate of the detergent must be uniform if the detergent is a solid, as opposed to a liquid. Solid detergents are generally preferred since they can be more concentrated, thereby reducing the overall size of the container. This, in effect, helps to achieve a second goal which is minimizing packaging waste.

The less material used to form the container for a given geometric shape, the less waste. This is important due to the cost of waste removal. For example, if the detergent is held in a large pail, the pail must be discarded after use and there must be some method of achieving the disposal of the container. Regulatory agencies may not permit the disposal of the container in the normal waste of the restaurant or cafeteria. Further, these establishments frequently directly pay for garbage removal and therefore minimizing the amount of waste is significant.

In addition to waste reduction, the overall cost of the container and the process of packaging the detergent in the container is important. The cost of the detergent will generally include the detergent composition itself, the dispensing system, the container and any processing required to package the detergent and subsequently use the detergent in the cafeteria or restaurant. Thus, the container should be designed in a way to minimize these costs as much as possible.

SUMMARY OF THE INVENTION

The present invention is premised on the realization that safe and effective distribution of ware washing detergent can be achieved by packaging the detergent in a container which has a large, flat self-supporting screen base and a flexible plastic film wall. The plastic film wall is bonded to the peripheral edge of the base. This is then filled with preferably tableted or pelleted detergent and simply sealed across the top portion of the film opposite the screen base to form the container. A peel-off cover or other removable cap seals the screen base prior to use. This can simply be removed to permit access to the detergent in use.

The screen preferably includes a central opening adapted to receive water which is sprayed up into the container to dissolve the detergent. The screen allows the formed water/detergent solution to drain and can be directed into the ware washing machine.

Further, the present invention will include a handle formed by heat sealing at the upper portion of the plastic film opposite the flat base. This provides for simple, easy handling prior to use and further permits one to lift the empty container of detergent from the dispenser after use.

This container is particularly adapted for use with a spray dispenser wherein water is simply sprayed against the detergent pellets which dissolve providing the detergent solution. A portion of the container can be at or above the dispenser wall with the handle at the uppermost position. This allows the container to be lifted, if necessary, to determine if the container is empty. The screen itself, however, prevents any loss of detergent.

Preferably, the screen portion is large, relative to the maximum cross-sectional area of the container, which would prevent complete bridging of the detergent and in effect keep most of the detergent resting directly against the screen. This is further facilitated by use of a tableted or pelleted detergent.

The objects and advantages of the present invention will be further appreciated in light of the following detailed description and drawings in which:

DETAILED DESCRIPTION

Figure 1:
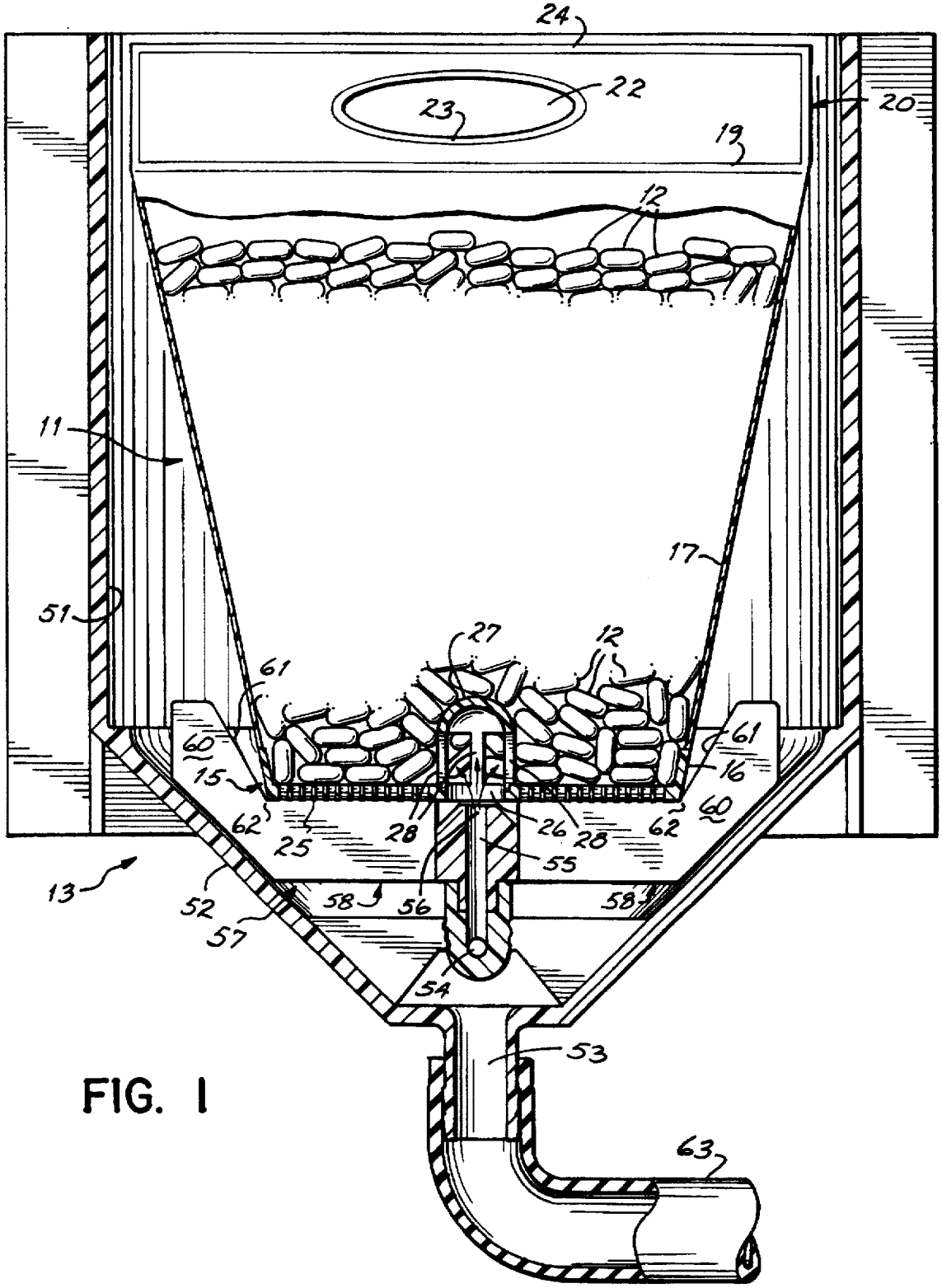
FIG. 1 is a cross-sectional view of the container of the present invention in a dispenser.
Figure 2:
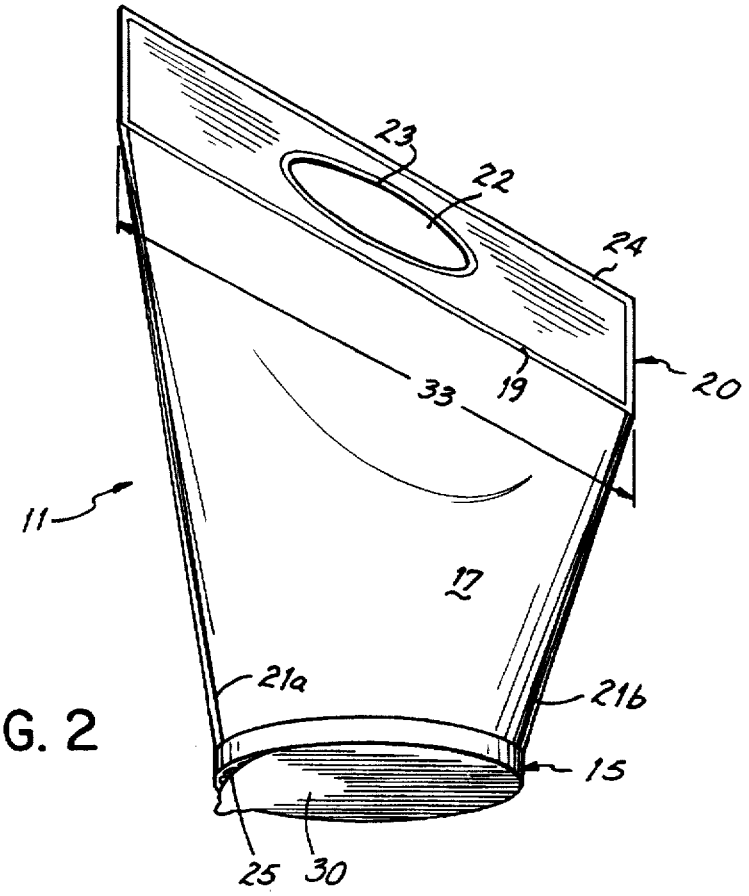
FIG. 2 is a perspective view of the container of the present invention.
Figure 3:
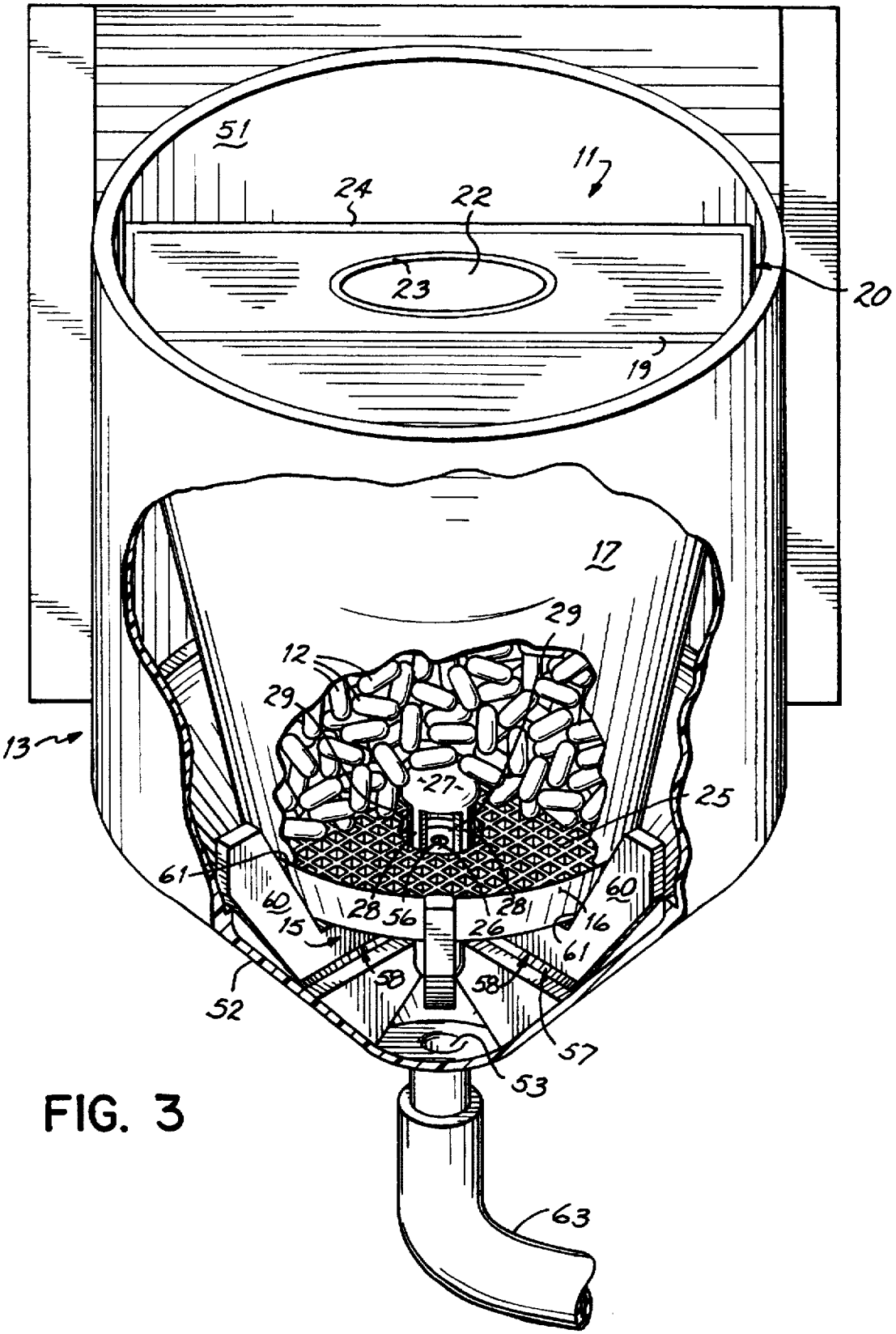
FIG. 3 is an overhead perspective view of the dispenser.

As shown more particularly in FIGS. 1 and 2, the present invention includes a container 11 which holds tablets or pellets 12, preferably detergent tablets. As shown in FIG. 1 and FIG. 3, container 11 is held in a dispenser 13. The container itself includes a flat base 15 having an upwardly-turned peripheral edge 16. Bonded to this upwardly-turned peripheral edge 16 is the flexible side wall 17. As shown in FIG. 1, the upper portion of the container 11 is closed by an upper seal 19.

The side wall 17 is preferably a flexible plastic material which is formed to the desired shape and fastened to the base 15. The side wall 17, as shown, can be formed from two sheets bonded together along two side seams and cut to shape. The seams **21*a* and 21*b* are the side seams of the container. As shown in the drawings the side wall 17** is a non-perforated plastic sheet.

The upper portion 20 of the container 11 also includes a handle 22 which is formed by peripheral heat seals 23 and 24.

As shown more particularly in FIG. 3, the base 15 includes a screen portion 25 and a central opening 26. The central opening 26 includes a domed portion 27 supported above the screen portion 25 by legs 28. The legs 28 provide lateral openings 29 for water to spray horizontally onto detergent resting on the screen portion 25. Preferably, the diameter of the base will be 70% of the diameter of the dispenser 13.

As shown in FIG. 2, the base surface is sealed by a peel-off seal 30, which is simply held to the base 15 by an adhesive such as a pressure-sensitive adhesive. A screw-on cap or snap-on lip can be used in place of the peel-off seal 30. Collectively, those are referred to as seal members.

As shown in FIG. 1, the side wall of the container has a taper from 0 to 40 degrees, preferably about 5 to about 20 degrees and most preferably 10 to 15 degrees which facilitates centering the container 11 within the dispenser 13 and improves stability. The taper does not cause or permit the tablets to bridge above the base 15. The tablets will always fall down and rest on the base 15.

Figure 4:
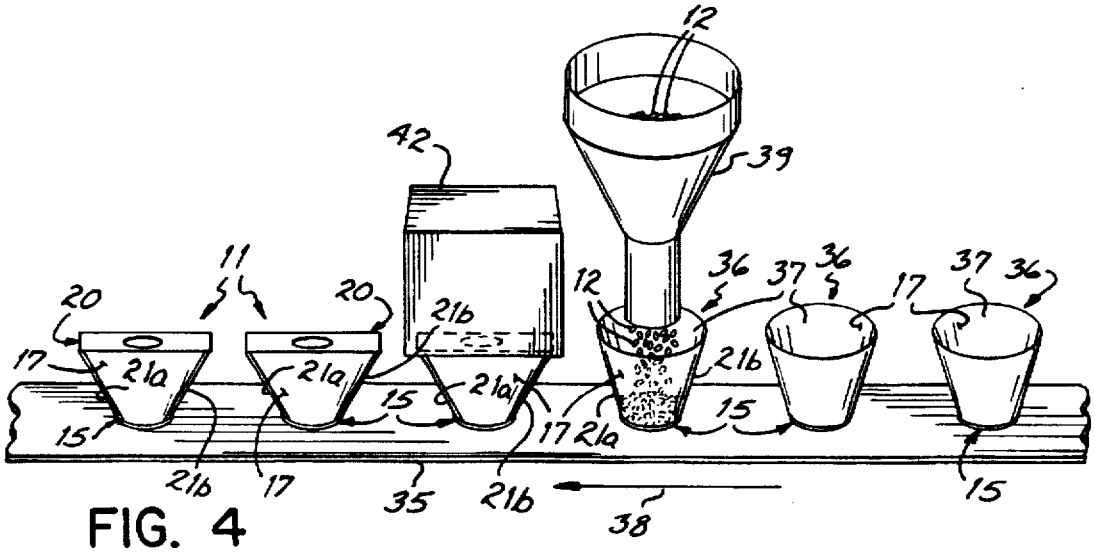
FIG. 4 is a diagrammatic depiction of one method of filling and forming the container of the present invention.

FIG. 4 shows a diagrammatic depiction of the method used in the present invention to fill the containers 11 with tablets 12. As shown, the open containers 36 with the sealed base 15 resting on a conveyor belt 35 are directed along the conveyor belt in the direction of arrow 38. These may be held in buckets or supported by grasping arms (not shown) as necessary to permit high speed filling. At filling station 39, the tablets 12 of detergent are released into the container through its top opening 37. The filled containers are then transferred to a closing station 42 which heat seals the container and, at the same time, die cuts and forms the handle. This is merely a diagrammatic depiction. There are a variety of different filling apparatuses which could be employed. One such type is a carousel filling apparatus.

In use, the container 11 is simply grasped by the handle 22. The seal or cap 30 is removed and the container 11 is placed in the dispenser 13. Dispenser 13 includes a side wall 51 which has a diameter which permits the container 11 to be placed within the dispenser with the base 1 5 preferably supported within the dispenser, as discussed below. Side wall 51 leads down to a sloped bottom wall 52, which in turn leads down to a drain 53.

The dispenser includes a water inlet 54 which is attached to an appropriate water source with appropriate back-flow protection (not shown). This water inlet leads through a stem portion 55 to a nozzle 56.

The bottom wall 52 of the dispenser 13 preferably includes a mounting fixture 57. This mounting fixture 57, as shown in FIGS. 1 and 3, has at least three radially-spaced arms 58 which terminate in upward tabs 60, each tab having a sloped wall 61 which terminates at the junction 62 of the tab 60 and the arms 58. As shown, the base 15 of container 11 rests on arm 58 with the peripheral edge at juncture 62.

As can be seen, the sloped walls 61 of the tabs help center the base surface 15 of container 11 so that the nozzle sprays water through the opening 26 immediately beneath the dome 27 of the base surface 15.

To dispense detergent, the filled container 11 is placed in the dispenser 13 and water is injected through inlet 54, up stem 55 and out nozzle 56. In a manner similar to that disclosed in U.S. Pat. No. 5,229,084, the water is deflected by dome 27 which directs water parallel to the base 15 and sprays against tablets 12 which are resting on the base surface 15. These tablets 12 dissolve or erode, forming a detergent mixture which drips through the openings in the screen 25 and eventually through drain 53 and out tube 63 where it is directed into a ware washing apparatus. As this continues, the bottom tablets will dissolve or erode and tablets above these will fall by gravity against the screen 25 and likewise be dissolved or eroded. This will continue until the entire contents of the container are emptied. Due to the design of this container, minimal, if any, detergent will remain unused on the screen.

Preferably, the screen and the container are both formed from the same family of plastics, preferably polyethylene, which will enable them to be very simply and easily recycled.

The tablets of the present invention can be a variety of different tablets. These can, for example, include the ware washing detergent disclosed in application filed Sep. 13, 1993 entitled "Tableted Detergent, Method of Manufacture and Use," U.S. Pat. No. 5,552,079, which is a high-caustic tableted ware washing detergent. Other tableted detergents and rinse aids and the like can also be employed such as detergents used for soaking pots and pans and glassware rinsing aids. This can also be used, if desired, in an industrial laundry apparatus.

The present invention provides a variety of different advantages. Attaching the screen portion to the base of the container facilitates handling of the detergent. It allows one to peel off the seal or remove the cap and hold the container opening side down without any significant loss of detergent, where the particle size is greater than the size of the openings in the screen. This also allows one to lift the container from the dispenser to view it. Also, it is no longer essential that the entire container remain within the dispenser. Although not shown, a significant portion of the container can even be above the dispenser wall.

With the large screen, relative to the diameter 33 of the container, there is no problem with detergent, particularly tableted detergent, being trapped above the screen. This facilitates dispensing of the detergent.

The container also minimizes waste because it is made from relatively minimal amounts of material. Finally, the construction of the container facilitates filling the container and packaging. The container does not have to be filled from a restricted opening, but rather can be filled from the largest portion of the container. Further, it can be very quickly and easily sealed using a combination heat seal and die which will also form the handle.

This has been a description of the present invention, along with the preferred method of practicing the present invention currently known to the inventors. However, the invention should only be defined by the appended claims.

Wherein we claim:

1. A detergent dispensing container comprising a generally rigid, self-supporting, planar screened base having a foraminous surface permitting fluid to flow down through said screened base;

a non-perforated side wall consisting of a flexible plastic sheet bonded to a peripheral edge of said base encircling said base;

an upper portion of said side wall sealed to itself to form an upper closed end of said container:

wherein said side wall is tapered from about 0 to about 400 relative to said screened base.

2. The container claimed in claim 1 having an said upper closed end, said closed end formed by a single seal traversing an upper portion of said plastic sheet, and wherein the container has a cross-section uniformly changing from a round cross-section at said screened base to a straight line at said closed end.

3. The container claimed in claim 2 containing a tableted detergent composition.

4. The container claimed in claim 3 wherein said closed end includes a handle.

5. The container claimed in claim 4 wherein said handle is formed from said plastic sheet.

6. The container claimed in claim 1 wherein said base includes a water inlet which projects water along the surface of said base.

7. The container claimed in claim 4 wherein said plastic sheet includes two angled side seams.

8. The container claimed in claim 2 wherein the side wall of said container is tapered from said screened base to said upper portion at an angle from about 5 to 20 degrees.

9. A detergent dispenser in combination with the container claimed in claim 8, said dispenser having a base support and a water jet adapted to spray water through said screened base to dissolve detergent in said container, said screened portion resting on said base support, wherein the diameter of the screened base of said container is 30% to 70% of an internal diameter of said dispenser.

10. A detergent dispensing container comprising a generally rigid, self-supporting, planer screened base having a foraminous surface permitting fluid to flow down through said screen base;

a non-perforated side wall consisting of a flexible plastic sheet bonded to a peripheral edge of said base, encircling said base;

an upper portion of said side wall sealed to itself to form an upper closed end of said container;

wherein said side wall is tapered from about 0° to 40° relative to said screened base;

powdered detergent contained in said container;

and wherein said base has a size relative to the maximum cross-sectional area of said container effective to prevent bridging of said detergent as it is being dispensed.

* * * * *